US006558183B1

(12) United States Patent
Ji et al.

(10) Patent No.: US 6,558,183 B1
(45) Date of Patent: May 6, 2003

(54) PLUG CONNECTOR WITH PIVOTALLY MOUNTED LOCK RELEASE BUTTONS

(75) Inventors: Ren-Hua Ji, Kunsan (CN); Hong Bin Zhou, Kunsan (CN)

(73) Assignee: Hon Hai Precision Ind. Co.?, Ltd., Taipei Hsien (TW)

( * ) Notice: Subject to any disclaimer, the term of this patent is extended or adjusted under 35 U.S.C. 154(b) by 0 days.

(21) Appl. No.: 10/106,272

(22) Filed: Mar. 25, 2002

(30) Foreign Application Priority Data

Feb. 6, 2002 (TW) ..... 91201369 U

(51) Int. Cl.[7] ..... H01R 13/627
(52) U.S. Cl. ..... 439/358; 439/607
(58) Field of Search ..... 439/357, 350, 439/352, 353, 358, 607, 609

(56) References Cited

U.S. PATENT DOCUMENTS 5,702,266 A * 12/1997 Jones ..... 439/357
5,941,725 A * 8/1999 Brennan et al. ..... 439/357
6,165,017 A * 12/2000 Kuo ..... 439/610
6,413,112 B2 * 7/2002 Semmeling et al. ..... 439/358
6,431,901 B1 * 8/2002 Yeh ..... 439/357

* cited by examiner

*Primary Examiner*—Hien Vu
(74) *Attorney, Agent, or Firm*—Wei Te Chung

(57) ABSTRACT

A plug connector (1) includes a casing (10), a mating portion (30) retained by the casing for mating with a mating connector, a pair of lock members (61) and a pair of release buttons (62). The lock members are fixed in the casing. The lock members each include a resilient lock arm (611). A pawl (612) extends from an end of each lock arm for engaging with a corresponding part of the mating connector. The release buttons are separately made and are pivotally mounted in the casing. The release buttons each include an actuating protrusion (622) for engaging with the lock arm of the lock member. The release button is operable to deflect the lock arm by the actuating protrusion for disengaging the pawl from the corresponding part of the mating connector.

3 Claims, 5 Drawing Sheets

PLUG CONNECTOR WITH PIVOTALLY MOUNTED LOCK RELEASE BUTTONS

FIELD OF THE INVENTION

The present invention relates to a plug connector, and more particularly, to a plug connector having separate release buttons pivotally mounted thereto for releasing locking engagement between the plug connector and a mating connector.

BACKGROUND OF THE INVENTION

There are a plurality of locking or latching designs or systems available in the art of electrical connectors for positively securing a plug connector to a mating connector or other mating structure. The locking designs generally include lock arms and release buttons. Actuation of the release buttons forces the lock arms to undergo elastic deformation to release locking engagement between the plug connector and the mating connector.

U.S. Pat. No. 5,486,117 discloses an electrical connector with a locking system. The locking system includes a pair of latch arms and a pair of release buttons. The release buttons are molded integrally with a housing of the connector. The lock arms are insert molded in the release buttons. However, because of the integral molding structure between the lock mechanism and the housing of the connector, it is very difficult to remove the housing together with the release buttons, from a mold in a manufacture process. Furthermore, a large force exerted by the release buttons is required for releasing the connector. The release buttons are susceptible to damage or fracture resulting in a short life-span.

In order to solve the problems associated with above-mentioned patent, U.S. Pat. No. 5,609,499 discloses an electrical connector with a locking mechanism. A pair of release buttons of the locking mechanism are mountable on a housing of the connector. Each release button forms a receiving slot for receiving a lock arm of the locking mechanism. A pair of engaging slots are respectively defined in upper and lower surfaces of each release button for engaging with the housing of the connector. However, each release button defines so many slots, resulting in a thin, weak and complicated structure. The complicated structure of the buttons results in a complicated manufacture process. Since the buttons are structurally weak, the plug connector has a short life-span.

Hence, a plug connector having improved release buttons is desired to overcome the above-mentioned shortcomings.

BRIEF SUMMARY OF THE INVENTION

A main object of the present invention is to provide a plug connector having pivotally mounted release buttons which can be easily manufactured.

Another object of the present invention is to provide a plug connector having pivotally mounted release buttons having a relatively long life-span.

A plug connector in accordance with the present invention comprises a casing, a mating portion retained by the casing, a pair of lock members and a pair of release buttons corresponding to the lock members. The casing includes an upper case and a lower case. The upper case forms a plurality of positioning frames for retaining the lock members. The lower case forms a plurality of retaining walls for retaining the release buttons. The lock members are respectively supported by opposite inner sides of the casing. The lock members each include a lock arm and a pawl extending from the lock arm. The pawls project beyond a front surface of the casing and are located on opposite sides of the mating portion. The release buttons are detachably supported by opposite inner sides of the casing. The release buttons each include an actuating arm and an actuating portion projecting from an end of the actuating arm. A pivoting pole is formed on an opposite end of the actuating arm for being rotatablely received in cavities defined in the casing, thereby pivotally retaining the release button in the casing.

The release buttons are not molded integrally with the casing and are made separately. The separate release buttons have a simple structure whereby the release buttons can be conveniently manufactured and easily assembled. Structural strength of the release buttons is greater than the conventional release buttons. The plug connector of the present invention, therefore, has a long life-span.

Other objects, advantages and novel features of the invention will become more apparent from the following detailed description when taken in conjunction with the accompanying drawings.

DETAILED DESCRIPTION OF THE INVENTION

Figure 1:
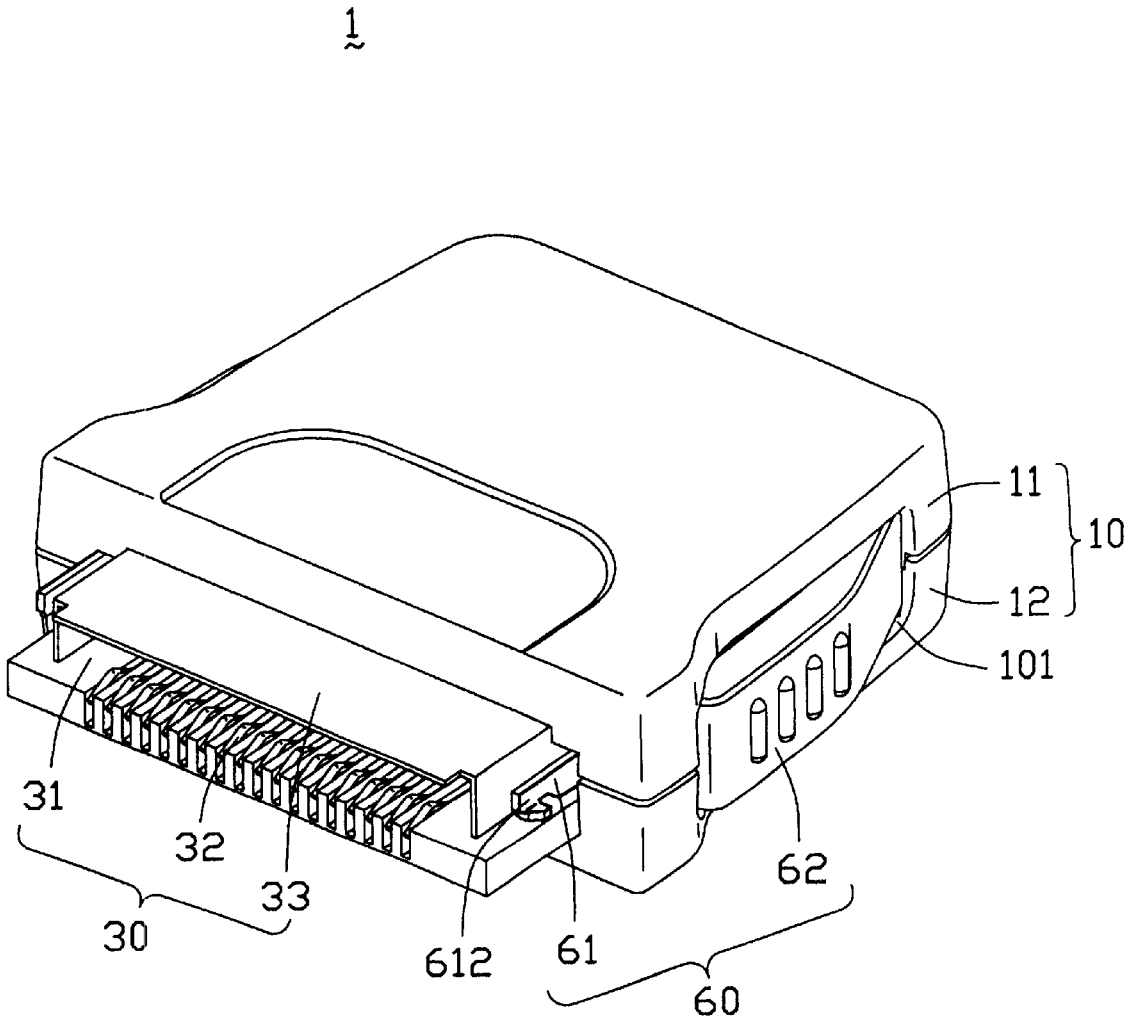
FIG. 1 is a perspective view of a plug connector of the present invention.
Figure 2:
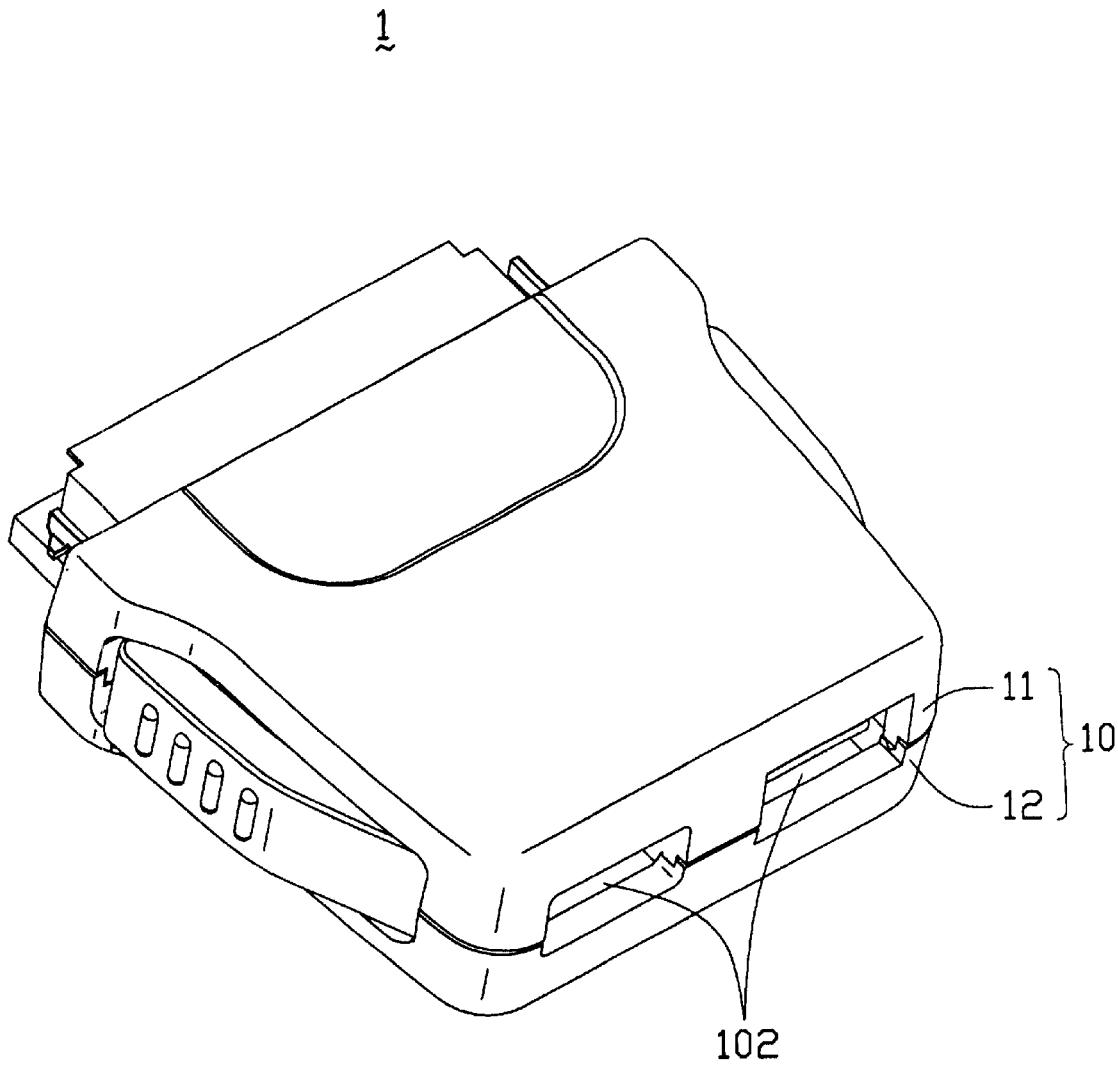
FIG. 2 is another perspective view of the plug connector.
Figure 3:
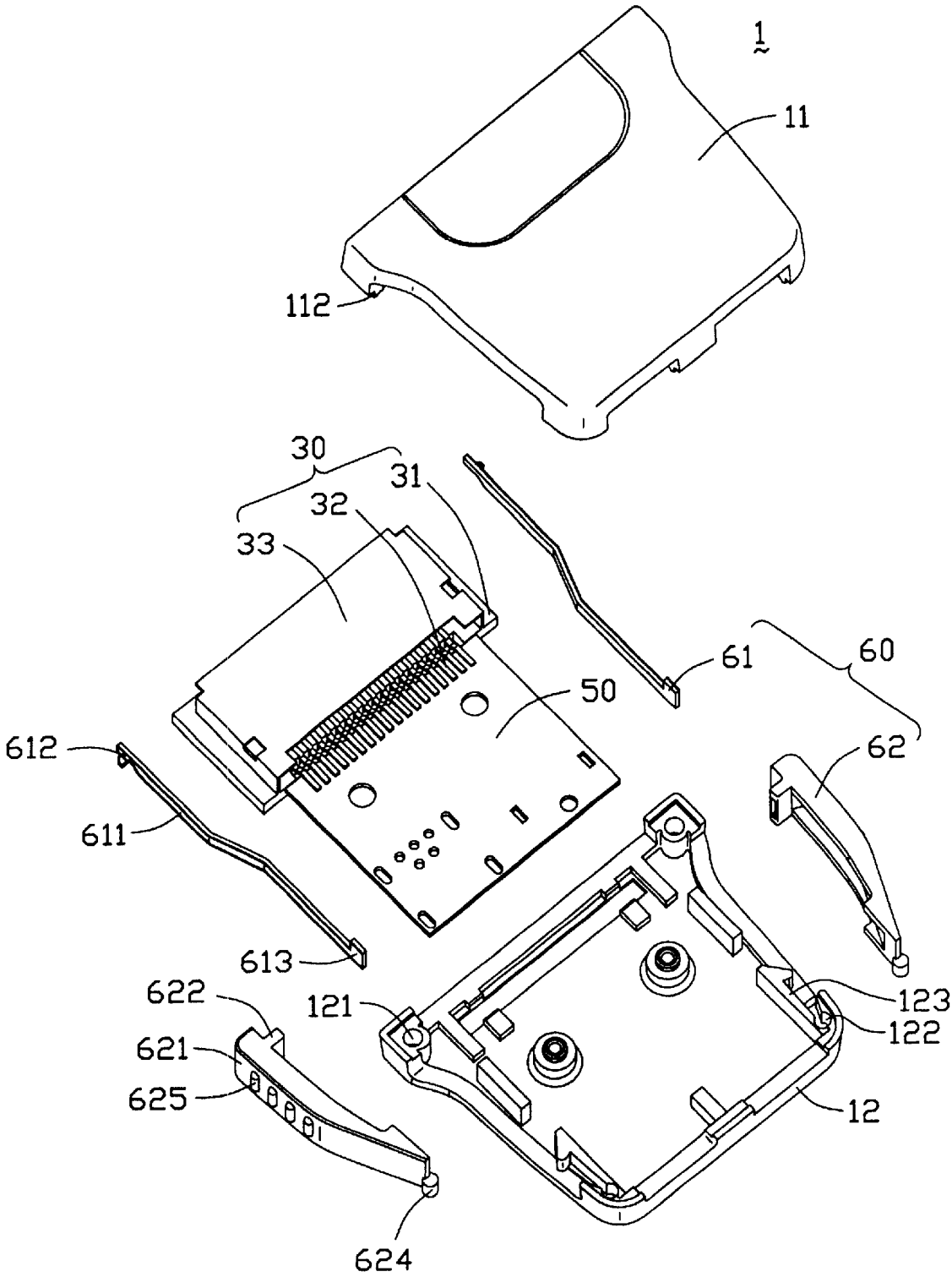
FIG. 3 is an exploded view of FIG. 2.

As shown in FIGS. 1–3, a plug connector 1 according to the present invention comprises an insulative casing 10, a mating portion 30, a circuit board 50 and a locking mechanism 60.

The casing 10 includes an upper case 11 and a lower case 12 mounted together defining an interior space (not labeled) for receiving the circuit board 50. The casing 10 defines a pair of receiving holes 101 in opposite side surfaces and a pair of rear openings 102 in a rear surface. Cables (not shown) may extend through the rear openings 102 to electrically connect with the circuit board 50.

Figure 4:
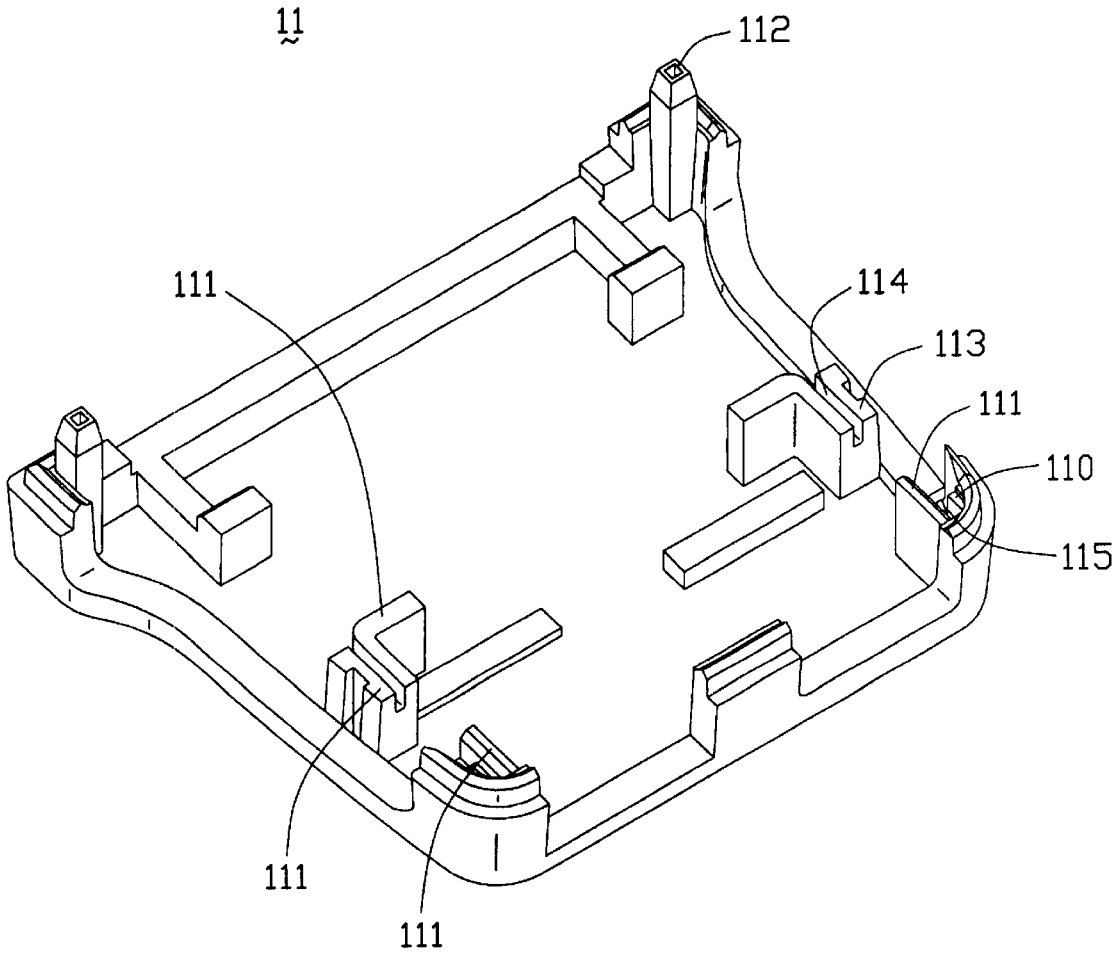
FIG. 4 is a perspective view of an upper case of the plug connector, particularly showing a lower surface of the upper case.
Figure 5:
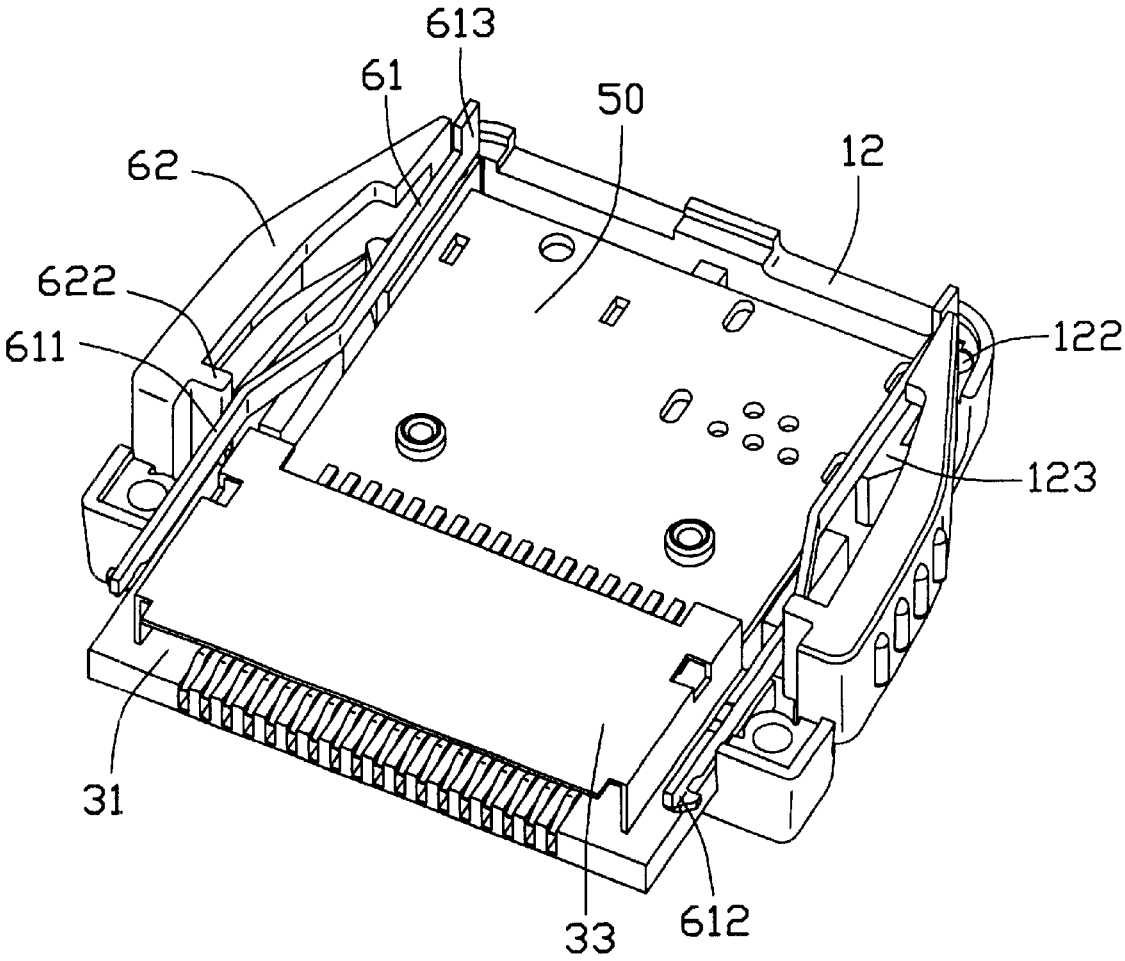
FIG. 5 is an assembled view of FIG. 3, wherein the upper case of the plug connector is removed for clarity.

Further referring to FIGS. 4–5, a protrusion 110 and a positioning frame 111 are formed inside the upper case 11 at each rear corner of the upper case 11, defining a first positioning slot 115 therebetween. A pair of blocks 113 downwardly project from a lower surface of the upper case 11 and are respectively adjacent the receiving holes 101. Each block 113 defines a second positioning slot 114. The second positioning slots 114 are respectively align with the first positioning slots 115. A pair of positioning pins 112 downwardly project from front corners of the upper case 11. The lower case 12 defines a pair of locating holes 121 for respectively engaging with the positioning pins 112 to attach the upper and lower cases 11, 12 together, thereby forming the casing 10. The lower case 12 defines a pair of cavities 122 in rear corners thereof. A pair of retaining walls 123 forwardly extend from a rear surface of the lower case 12 and are respectively adjacent the cavities 122.

Particularly referring to FIG. 3, the mating portion 30 is attached to the circuit board 50 and partially extending beyond the casing 10 for electrically mating with a mating connector (not shown). The mating portion 30 comprises a housing 31, a plurality of contacts 32 retained in the housing 31 and a shielding 33 encasing the housing 31. The contacts 32 have tails (not labeled) extending beyond the housing 31 and soldered or otherwise electrically connected to the circuit board 50.

The locking mechanism 60 comprises a pair of resilient lock members 61 and a pair of release buttons 62 corresponding to the lock members 61. Each lock member 61 is substantially elongated and includes a lock arm 611. A pawl 612 is formed on a remote end of each lock arm 611. A fixing foot 613 is formed on an opposite end of each lock arm 611.

The release buttons 62 each include an actuating arm 621. An actuating protrusion 622 projects inwardly from an end of each actuating arm 621 and engageable with the corresponding lock arm 611 for resiliently deforming the lock member 61. The actuating arm 621 forms a pivoting pole 624 on an opposite end thereof. The pivoting poles 624 are rotatablely and respectively received the cavities 122 of the lower case 12 for pivoting the release buttons 62 to the casing 10. Ribs 625 are formed on an outside surface (not labeled) of each release button 62 for manually depressing the release buttons 62 to deform the lock members 61.

Particularly referring to FIG. 5, the circuit board 50 is located and fixed between the upper and lower cases 11, 12. The mating portion 30 is fixed by a front portion of the casing 10 and partially projects beyond a front surface of the casing 10. The lock members 61 are mounted respectively at corresponding sides of the casing 10 with the fixing foots 613 receivingly retained in the first positioning slots 115 and the lock arms 611 retained in the second positioning slots 114. The pawls 612 project from the front surface of the casing 10 and are located on opposite sides of the mating portion 30. The release buttons 62 are located respectively beside the corresponding lock members 61 and partially protruding beyond the side surfaces of the casing 10 through the corresponding receiving holes 101. The actuating arms 621 are supported and retained by the retaining walls 123 of the lower case 12.

In use, the plug connector 1 electrically mates with a mating connector mounted on a circuit board of a first electrical equipment (not shown) for connecting the first electrical equipment to a second electrical equipment (not shown) that is mounted to the cables. The mating portion 30 of the plug connector 1 engages with the mating connector and the pawls 612 of the plug connector 1 respectively engage with counterpart locking portions of the mating connector to secure the plug connector 1 to the mating connector. To disengage the plug connector 1 from the mating connector, the release buttons 62 are inwardly depressed, the actuating protrusions 622 of the release buttons 62 inwardly deflect the lock arms 611 of the lock members 61 thereby disengaging the pawls 612 from the counterpart lock portions of the mating connector and releasing the plug connector 1 from the mating connector.

The release buttons 62 are not molded integrally with the casing 10 and are made separately. This gives the release buttons 62 simple structure that is easy to make. Thus, the release buttons 62 are conveniently manufactured and are easily assembled. Structural strength of the separate release buttons 62 is greater than the conventional release buttons that are integrated with the casing. The plug connector 1 of the present invention, therefore, has a long life-span.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector comprising:

a casing retaining a mating portion having an insulative housing therein for mating a mating connector;

a conductive shell being seated upon and only shielding a top face of the housing except edge regions thereof;

at least one lock member fixed in the casing, comprising a resilient lock arm and a pawl formed on a free end of the lock arm for engaging with a corresponding part of the mating connector; and at least one separate release button being pivotally mounted to the casing, and comprising an actuating protrusion engageable with the lock arm;

wherein the at least one release button is operable to deflect the lock arm by the actuating protrusion for disengaging the pawl from the corresponding part of the mating connector; wherein the casing comprises an upper case and a lower case; wherein the release button comprises an actuating arm and a pivoting pole at an end thereof, the actuating protrusion projecting from the actuating arm, wherein the casing defines a receiving hole in a side wall thereof for receiving the release button with the release button partially protruding beyond the casing, and wherein the lower case forms a retaining wall for supporting and retaining the actuating arm, and defines a cavity for rotatablely receiving the pivoting pole to pivotally mount the release button to the casing.

2. The plug connector as claimed in claim 1, wherein the upper case defines at least one positioning slot for retaining the lock arm, the positioning slot being adjacent to the retaining wall, thereby retaining the lock member beside the release button.

3. An electrical connector comprising:

an insulative casing retaining a mating portion therein for mating a complementary connector;

the casing comprising an upper case and a lower case;

said mating portion including an insulative housing with a plurality of contacts therein, tails of said contacts soldered to a printed circuit board behind the housing, a conductive shell being seated upon and only shielding a top face of the housing except edge regions thereof and having a less dimension than the housing along a transverse direction thereof;

a pair of metallic lock members fixed to two sides of the casing, each of said locking members including a resilient locking arm with a paw at a front end thereof, the paw substantially positioned on the edge regions and beside the shell; and a pair of discrete release buttons each having pivot pole at one end of and being pivotally attached to said two sides of the lower case of the casing and covering at least partially the corresponding lock members, respectively.

* * * * *